US007350351B2

(12) United States Patent
Ueshima et al.

(10) Patent No.: US 7,350,351 B2
(45) Date of Patent: Apr. 1, 2008

(54) EXHAUST SYSTEM OF ENGINE OF MOTORCYCLE

(75) Inventors: Atsushi Ueshima, Akashi (JP); Hidenori Shinonaga, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/396,271

(22) Filed: Mar. 30, 2006

(65) Prior Publication Data

US 2006/0236685 A1 Oct. 26, 2006

(30) Foreign Application Priority Data

Mar. 31, 2005 (JP) ..... 2005-101393

(51) Int. Cl.
*F01N 3/10* (2006.01)

(52) U.S. Cl. ..... 60/299; 60/312; 60/313; 60/322; 60/323; 12/194

(58) Field of Classification Search ..... 60/272, 60/274, 282, 299, 300, 313, 312, 314, 322, 60/323; D12/114, 194
See application file for complete search history.

(56) References Cited

U.S. PATENT DOCUMENTS 5,293,744 A * 3/1994 Imagawa et al. ..... 60/302
5,937,640 A * 8/1999 Krzykowski et al. ..... 60/284
6,052,990 A * 4/2000 Gecker, Jr. ..... 60/312
6,247,305 B1 * 6/2001 Bassani ..... 60/312
6,332,314 B1 * 12/2001 Nakade et al. ..... 60/299
6,374,599 B1 * 4/2002 Thomas ..... 60/312

FOREIGN PATENT DOCUMENTS

| | | |
|---|---|---|
| DE | 196 34 887 | 3/1998 |
| EP | 1 103 701 | 5/2001 |
| FR | 2 543 078 | 9/1984 |
| JP | 59-143722 | 8/1984 |
| JP | 62-082217 | 4/1987 |
| JP | 05-319352 | 12/1993 |
| JP | 06-144329 | 5/1994 |
| JP | 08-099669 | 4/1996 |
| JP | HEI. 10-103046 | 4/1998 |

* cited by examiner

*Primary Examiner*—Binh Q. Tran
(74) *Attorney, Agent, or Firm*—Alleman Hall McCoy Russell & Tuttle LLP

(57) ABSTRACT

An exhaust system of an engine of a motorcycle, including an exhaust pipe configured to extend in one of an upward direction and a downward direction from an exhaust port formed at a front portion of a cylinder head of the engine and to then be bent to extend in an opposite direction to form a bent portion at a location in front of the engine.

10 Claims, 8 Drawing Sheets

EXHAUST SYSTEM OF ENGINE OF MOTORCYCLE

TECHNICAL FIELD

The present invention generally relates to an exhaust system coupled to an engine of a motorcycle and, particularly to arrangement of exhaust pipes included in the exhaust system.

BACKGROUND ART

There are motorcycles equipped with, for example, an in-line multi-cylinder engine in which an exhaust system is coupled to the engine and is configured to purify an exhaust gas resulting from combustion and to discharge the resulting exhaust gas outside the motorcycle. Japanese Laid-Open Patent Application Publication No. Hei. 10-103046 discloses such a motorcycle. To be specific, an engine of the motorcycle includes a crankcase, a cylinder block located on the crankcase, and a cylinder head that is located on the cylinder block and has a plurality of exhaust ports that open forward of a vehicle body. An exhaust pipe extends downward from the exhaust ports, under the crankcase, and toward a rear region of the engine.

Then, the exhaust pipe extends upward and further rearward with the exhaust pipe supported on a seat rail of the vehicle body. In another construction, an exhaust pipe extends to a rear region of the engine and further extends rearward to a position horizontally lateral of a rear wheel with the exhaust pipe supported on a lower frame of the vehicle body. The length of the exhaust pipe extending from the exhaust ports of the engine to the rear region of the vehicle body is suitably set depending on engine performance, for example, an engine displacement or an engine speed.

In some exhaust systems, an exhaust gas purifier is disposed at a location of an exhaust pipe under the engine. Typically, the exhaust gas purifier contains a catalyst to purify the exhaust gas flowing therethrough. The catalyst is able to produce a higher purifying effect for an exhaust gas with a higher temperature. A muffler is coupled to a rear portion of the exhaust pipe to reduce a noise of the exhaust gas.

Among components equipped in a motorcycle, an engine is often the heaviest. Therefore, a center of gravity of the motorcycle typically is located in the vicinity of a center of gravity of the engine. In some motorcycles, a center of gravity of the engine and other components is suitably positioned in the vicinity of the center of gravity of the motorcycle. In the motorcycle equipped with the exhaust system constructed as described above, the elongated exhaust pipe extends in a longitudinal direction of a vehicle body of the motorcycle. Further, a muffler, which is a component with a heavy weight, is disposed distant rearward from the center of gravity of the motorcycle. As a result, it is difficult to position the components in the exhaust system in the vicinity of the center of gravity of the motorcycle.

SUMMARY OF THE INVENTION

The present invention addresses the above mentioned problem, and an object of the present invention is to provide an exhaust system including exhaust pipes arranged suitably so that components in the exhaust system are positioned in the vicinity of a center of gravity of a motorcycle.

According to the present invention, there is provided an exhaust system of an engine of a motorcycle, comprising an exhaust pipe configured to extend in one of an upward direction and a downward direction from an exhaust port formed at a front portion of a cylinder head of the engine and to then be bent to extend in an opposite direction to form a bent portion at a location in front of the engine.

With such a construction, the components in the exhaust system can be arranged in the vicinity of the center of gravity of the engine, and hence the center of gravity of the motorcycle, while ensuring a suitable length of the exhaust pipes forming the exhaust system.

The bent portion may include a lower bent portion and an upper bent portion located above the lower bent portion, the exhaust pipe extending in the downward direction and then being bent to extend in the upward direction to form the lower bent portion, the exhaust pipe extending in the upward direction and then being bent to extend in the downward direction to form the upper bent portion. The exhaust pipe may be configured to extend downward from the exhaust port, upward from the lower bent portion, downward from the upper bent portion and then rearward. With such a construction, a sufficient length of the exhaust pipe can be obtained.

The exhaust system may further comprise a muffler that is located below a crankcase of the engine and is coupled to the exhaust pipe. With such a construction, the muffler, which is a component with a heavy weight, can be disposed in the vicinity of the center of gravity of the engine, and the components in the exhaust system can be arranged in the vicinity of the center of gravity of the motorcycle.

The exhaust system may further comprise an exhaust gas purifier that is disposed at a location of the exhaust pipe between the lower bent portion and the upper bent portion and is configured to purify an exhaust gas emitted from the exhaust port of the engine. With such a construction, the exhaust gas purifier can be installed in the above mentioned exhaust system.

The engine may be an in-line multi-cylinder engine and the exhaust port may be one of a plurality of exhaust ports arranged in a width direction of a vehicle body of the motorcycle. The plurality of exhaust ports may be divided into a right exhaust port group and a left exhaust port group that are located on a right side and on a left side of the vehicle body, respectively, as viewed from above, and the exhaust pipe includes a right pipe group extending from the right exhaust port group and a left pipe group extending from the left exhaust port group. Pipes of at least one of the right pipe group and the left pipe group may be gathered to form one pipe at a location between the lower bent portion and the upper bent portion, and the exhaust gas purifier may be disposed at the one pipe.

With such a construction, the number of exhaust gas purifiers can be reduced in contrast to a case where the exhaust gas purifiers are provided for the respective exhaust pipes extending from the plurality of exhaust pipes. Therefore, a manufacturing cost can be reduced, and the exhaust gas purifier can be disposed in a relatively small space in front of the engine.

The engine may be an in-line four-cylinder engine and the exhaust port may be one of four exhaust ports arranged in a width direction of a vehicle body of the motorcycle. The exhaust pipe may include a right upstream pipe through which exhaust gases from two exhaust ports located on a right side of the vehicle body as viewed from above are guided and gathered, a left upstream pipe through which exhaust gases from two exhaust ports located on a left side of the vehicle body as viewed from above are guided and gathered, an intermediate pipe through which exhaust gases from the right upstream pipe and the left upstream pipe are guided and gathered, and a downstream pipe through which an exhaust gas from the intermediate pipe is guided outside the engine. Each of the right upstream pipe and the left upstream pipe may have the lower bent portion and may be coupled to the intermediate pipe at a location downstream of the lower bent portion. The intermediate pipe may have the upper bent portion and may be coupled to the downstream pipe at a location downstream of the upper bent portion.

With such a construction, in the exhaust system coupled to the in-line four-cylinder engine, a suitable length of the exhaust pipe can be obtained.

The intermediate pipe may include two branch pipes coupled to the right upstream pipe and the left upstream pipe, respectively. The branch pipes may extend upward, may be curved inward in the width direction of the vehicle body and bent at the upper bent portion, and may then be gathered. The downstream pipe may extend downward through a location between the two branch pipes of the intermediate pipe.

With such a construction, since the branch pipes of the intermediate pipe are curved to the right side or to the left side at the upper bent portion, the dimension of the exhaust pipe in a longitudinal direction of the vehicle body in front of the engine can be reduced. In addition, since the exhaust pipe has a structure that is substantially symmetric in the width direction, weight in the width direction is well-balanced.

The intermediate pipe may have two branch pipes coupled to the right upstream pipe and the left upstream pipe. The branch pipes may extend upward to be located on one of right and left sides relative to a center in the width direction of the vehicle body, may be curved and bent toward an opposite side at the upper bent portion, and may then be gathered. The downstream pipe may extend downward through the opposite side of the branch pipes.

Because of the upper bent portion curved to a lateral side, the dimension of the exhaust pipe in the longitudinal direction in front of the engine can be reduced. In addition, the downstream pipe extending downward to be located on the opposite side in the width direction is suitable for use in a construction in which the exhaust pipe (downstream pipe) extends through the right side or the left side under the crankcase.

The exhaust system may further comprise an exhaust gas purifier configured to purify an exhaust gas emitted from the exhaust port of the engine. The left upstream pipe and the right upstream pipe may be each coupled to the intermediate pipe through the exhaust gas purifier.

The downstream pipe may be divided into right and left branch pipes having downstream end portions coupled to mufflers, respectively.

The engine may be an in-line four-cylinder engine, and the exhaust port may be one of four exhaust ports arranged in a width direction of a vehicle body of the motorcycle. The exhaust pipe may include a right upstream pipe through which exhaust gases from two exhaust ports located on a right side of the vehicle body as viewed from above are guided and gathered, a left upstream pipe through which exhaust gases from two exhaust ports located on a left side of the vehicle body are guided and gathered, a right downstream pipe through which the exhaust gas from the right upstream pipe flows, and a left downstream pipe through which the exhaust gas from the left upstream pipe flows. Each of the right upstream pipe and the left upstream pipe may have the lower bent portion and the right upstream pipe and the left upstream pipe may be coupled to the right downstream pipe and the left downstream pipe, respectively, at a location downstream of the lower bent portion. Each of the right downstream pipe and the left downstream pipe may have the upper bent portion and the right downstream pipe and the left downstream pipe may be coupled to right and left mufflers, respectively, at a location downstream of the upper bent portions.

The above and further objects and features of the invention will more fully be apparent from the detailed description with accompanying drawings.

DETAILED DESCRIPTION OF THE PREFERRED EMBODIMENTS

Figure 1:
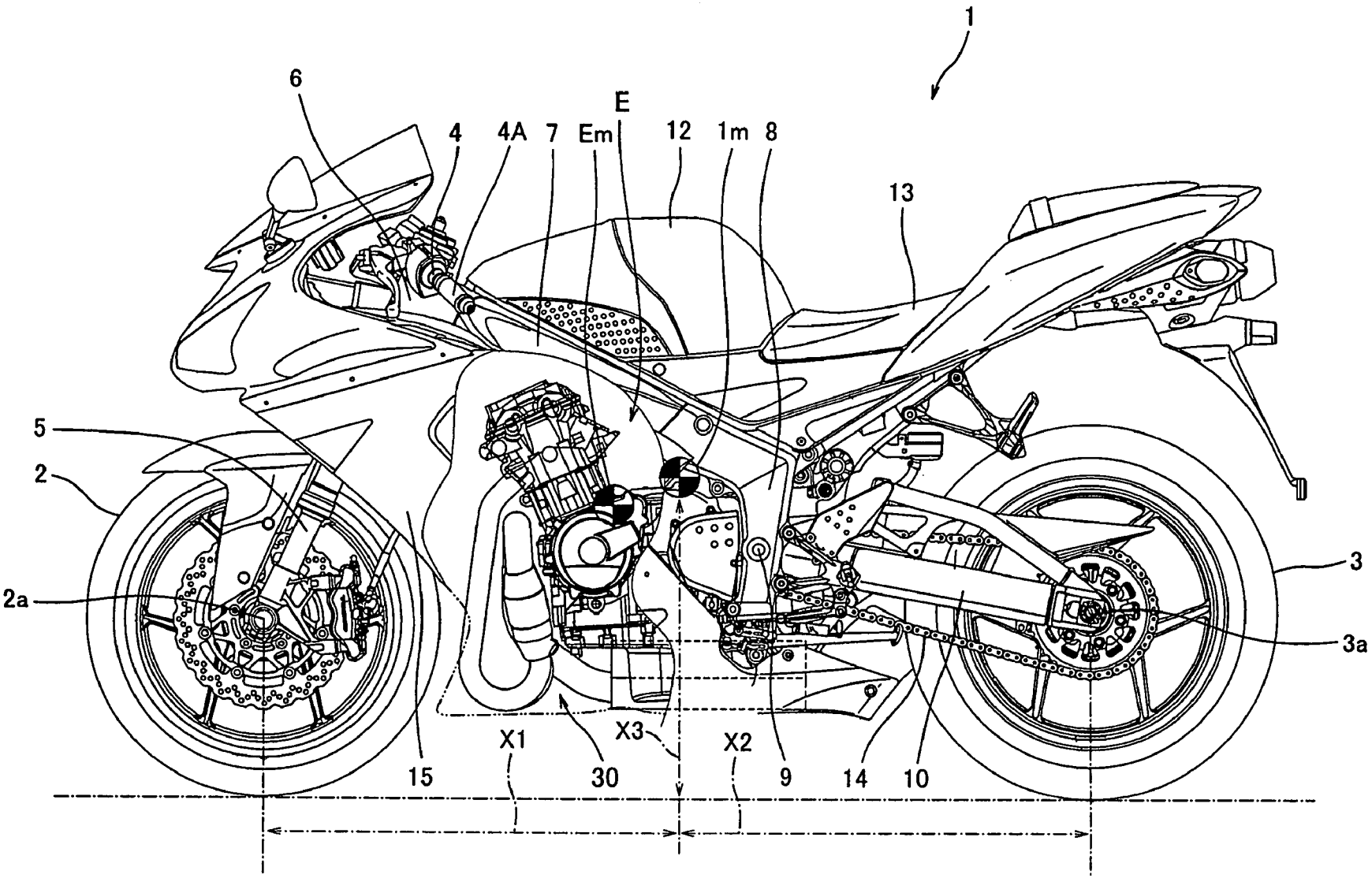
FIG. 1 is a left side view of a road sport type motorcycle that is equipped with an exhaust system according to embodiments of the present invention, a part of which is cut away.

Hereinafter, embodiments of an exhaust system of an engine mounted in a motorcycle of the present invention will be described with reference to the accompanying drawings. FIG. 1 is a left side view of a road sport type motorcycle that is equipped with an exhaust system according to the embodiments of the present invention, a part of which is cut away. As used herein, the term "directions" refers to directions from the perspective of a rider mounting a motorcycle 1 of FIG. 1.

Turning now to FIG. 1, the motorcycle 1 includes a front wheel 2 and a rear wheel 3. The front wheel 2 is rotatably mounted to a lower region of a front fork 5 extending substantially vertically. A bar-type steering handle 4 is attached to an upper region of the front fork 5 and is configured to extend in a width direction of a vehicle body of the motorcycle 1. The front fork 5 is mounted to a steering shaft (not shown) extending in parallel with the front fork 5. The steering shaft is rotatably supported by a head pipe 6 of the vehicle body. When the rider rotates the steering handle 4 clockwise or counterclockwise, the front wheel 2 is turned to a desired direction.

A pair of right and left main frames 7 (only left main frame 7 is illustrated in FIG. 1), forming a frame of the vehicle body, extend rearward from the head pipe 6. Pivot frames (swing arm brackets) 8 extend downward from rear regions of the main frames 7. A swing arm 10 is pivotally mounted at a front end portion thereof to a pivot 9 attached on the left pivot frame 8. The rear wheel 3 is rotatably mounted to a rear end portion of the swing arm 10.

A fuel tank 12 is disposed above the main frames 7 and behind the steering handle 4. A straddle-type seat 13 is disposed behind the fuel tank 12. An engine E is mounted between and under the right and left main frames 7. The engine E is an in-line four-cylinder four-cycle engine, and is mounted in such a manner that a crankshaft 20A (see FIG. 2) extends in a width direction of the vehicle body.

An exhaust system 30 mentioned later is coupled to the engine E. An exhaust gas generated in the engine E is purified while flowing through the exhaust system 30 and is discharged outside the motorcycle 1. An output of the engine E is transmitted, through a chain 14, to a rear wheel 3, which thereby rotates. As a result, the motorcycle 1 obtains a propulsion force. In recent years, the size of engines has been decreasing with improvement of engine performance. So, an extra space can be formed in front of the engine E mounted in the motorcycle 1 so that the exhaust system 30 is able to be easily mounted therein.

A cowling 15 is mounted to cover a front region of the motorcycle 1, i.e., an upper region of the front fork 5 and side regions of the engine E and the exhaust system 30. Mounting the seat 13, the rider grips a grip 4A attached at an end portion of the steering handle 4 and puts feet on foot rests provided in the vicinity of a rear region of the engine E. Under this condition, the rider is ready to start-up the motorcycle 1. In the motorcycle 1 mentioned above, a center of gravity 1*m* is located in the vicinity of a middle of a wheel base to be spaced a predetermined distance apart from a ground. For example, with the fuel tank 12 filled with a fuel, the center of gravity 1*m* of the motorcycle 1 is located between the front and rear wheels 2 and 3 such that a distance X1 between the center of gravity 1*m* and a rotational axis 2*a* of the front wheel 2 is equal to a distance X2 between the center of gravity 1*m* and a rotational axis 3*a* of the rear wheel 3, and a distance X3 from the ground is about 500 to 600 millimeters.

Embodiment 1

Figure 2:
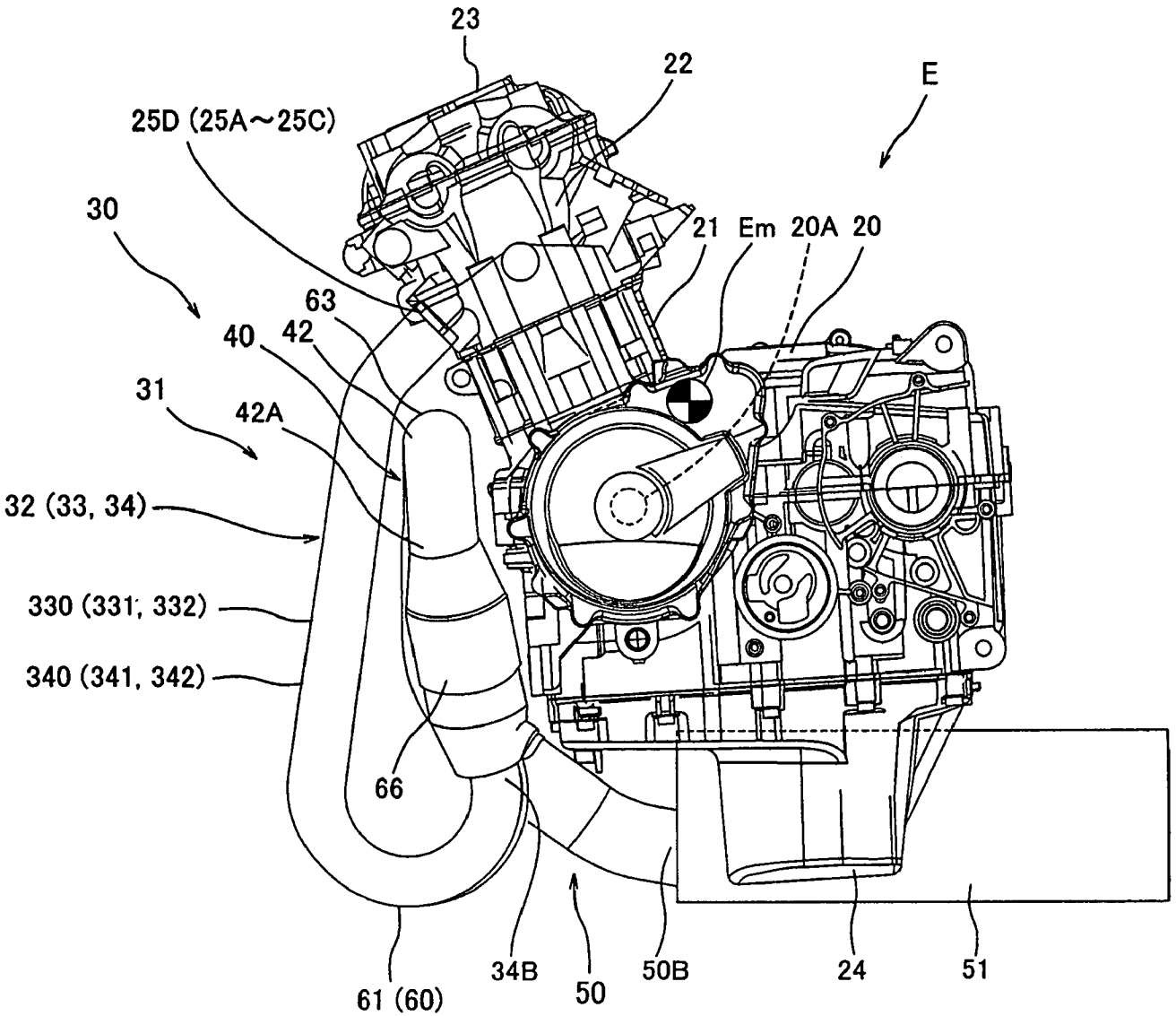
FIG. 2 is a left side view showing an engine mounted in the motorcycle of FIG. 1, and an exhaust system according to a first embodiment of the present invention, which is coupled to the engine.

FIG. 2 is a left side view showing the engine E mounted in the motorcycle 1 of FIG. 1, and the exhaust system 30 according to the first embodiment of the present invention. As shown in FIG. 2, the engine E includes a crankcase 20 configured to accommodate the crankshaft 20A, and a cylinder block 21 that is coupled to an upper region of the crankcase 20 and includes four cylinders. The cylinder block 21 is disposed in such a manner that center axes of the respective cylinders are tilted slightly forward. The engine E further includes a cylinder head 22 that is coupled to an upper region of the cylinder block 21 and forms a combustion chamber (not shown) together with the cylinder block 21, and a cylinder head cover 23 provided over the cylinder head 22 to cover the cylinder head 22 from above. An oil pan 24 is coupled to a left side of a lower region of the crankcase 20 and is configured to temporarily store lubricating oil (see FIG. 4). A center of gravity Em of the engine E to which the exhaust system 30 is not coupled is located above and behind the crankshaft 20A, and near the center of gravity 1*m* of the motorcycle 1 (FIG. 1).

Four exhaust ports 25A to 25D are formed in a front portion of the cylinder head 22 so as to correspond to the respective cylinders of the engine E (in FIG. 2, leftmost exhaust port 25D is illustrated). The exhaust ports 25A to 25D are configured to open forward and downward. An upstream end portion of the exhaust pipe 31 included in the exhaust system 30 is coupled to the exhaust ports 25A to 25D. As used herein, the terms "upstream" and "downstream" mean upstream and downstream in a flow of the exhaust gas emitted from the exhaust ports 25A to 25D of the engine E and flowing in exhaust systems mentioned below.

Figure 3:
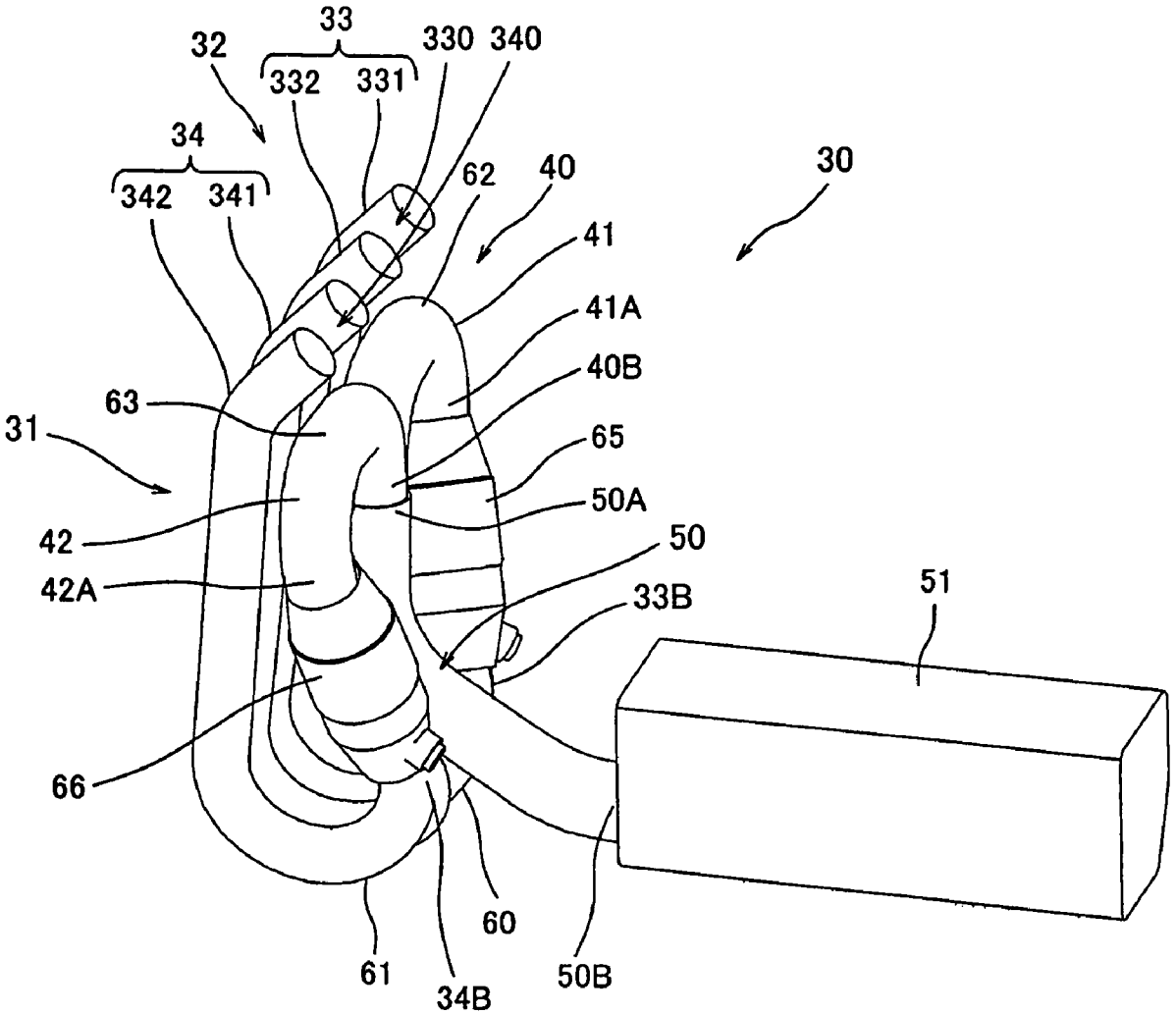
FIG. 3 is a perspective view showing a construction of the exhaust system of FIG. 2.
Figure 4:
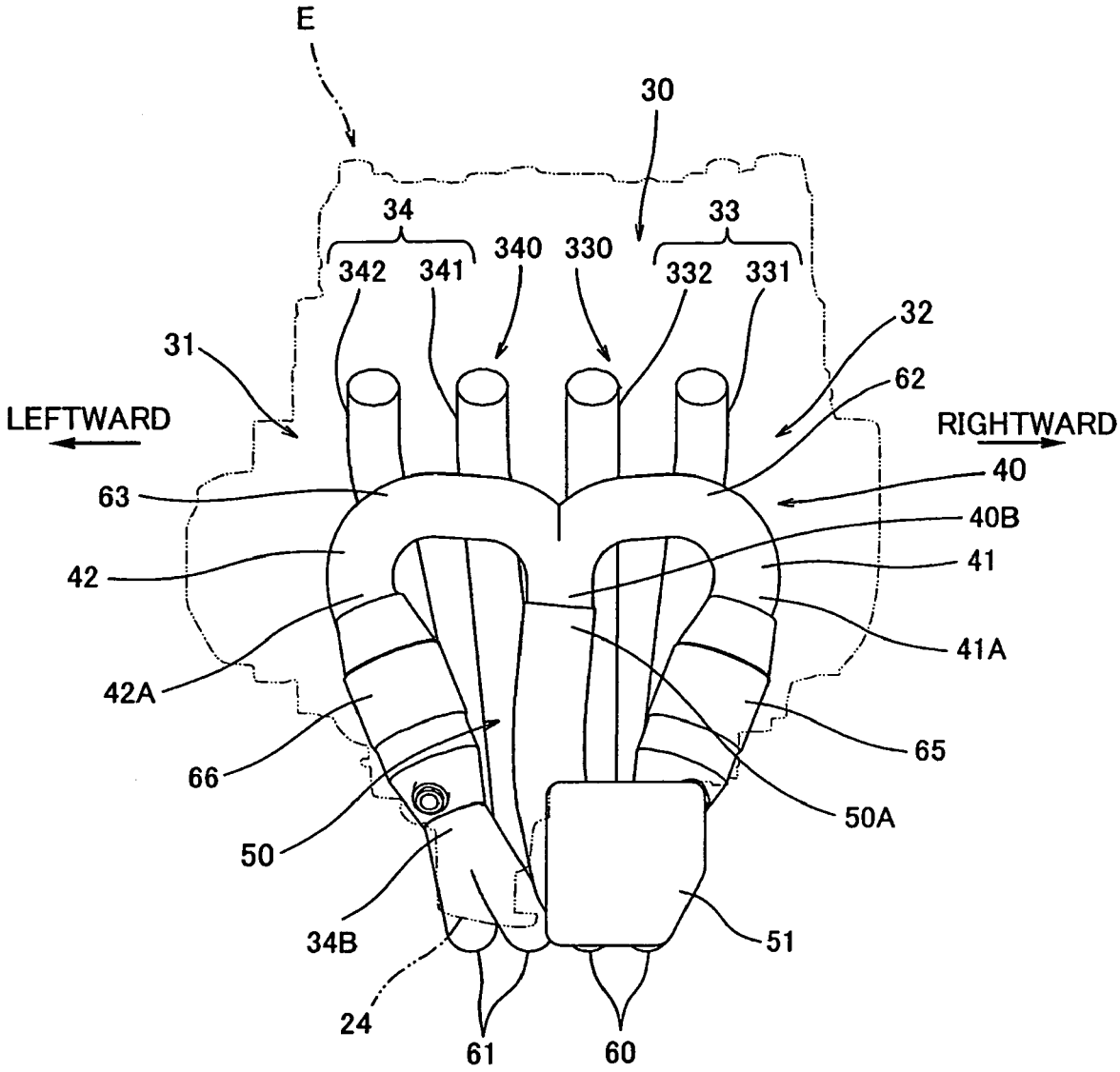
FIG. 4 is a rear view of the exhaust system of FIG. 3, showing an outer shape of the engine by a two-dotted line to illustrate how components in the exhaust system are arranged with respect to the engine.

FIG. 3 is a perspective view showing a construction of the exhaust system 30 of FIG. 2. FIG. 4 is a rear view of the exhaust system 30 of FIG. 3, showing an outer shape of the engine E by a two-dotted line to illustrate how components in the exhaust system 30 are arranged with respect to the engine E. As shown in FIGS. 2 and 3, the exhaust pipe 31 extends forward and downward from the exhaust ports 25A to 25D of the engine E.

To be specific, an upstream pipe 32 forming an upstream portion of the exhaust pipe 31 is coupled to the respective exhaust ports 25A to 25D of the engine E. The upstream pipe 32 includes a right upstream pipe 33 through which exhaust gases emitted from the exhaust ports 25A and 25B on the right side (left side as the motorcycle 1 is viewed from front) are guided and gathered, and a left upstream pipe 34 through which exhaust gases emitted from the exhaust ports 25C and 25D on the left side (right side as the motorcycle 1 is viewed from front) are guided and gathered. The right upstream pipe 33 includes right upstream branch pipes 331 and 332 that have upstream end portions coupled to the right exhaust ports 25A and 25B and which are configured to form a right upstream pipe group 330. The left upstream pipe 34 includes left upstream branch pipes 341 and 342 that have upstream end portions coupled to the left exhaust ports 25C and 25D and which are configured to form a left upstream pipe group 340.

The right upstream branch pipes 331 and 332 and the left upstream branch pipes 341 and 342 extend forward and downward from the exhaust ports 25A to 25D, respectively, and then are bent in front of the cylinder block 21 to extend downward to a location in front of the oil pan 24. Also, the respective branch pipes 331, 332, 341, and 342 extend closer to a center in the width direction of the vehicle body from the exhaust ports 25A to 25D toward the location in front of the oil pan 24 (see FIG. 4).

As shown in FIGS. 3 and 4, the right upstream branch pipes 331 and 332 of the right upstream pipe 33 are bent rearward and upward at the location in front of the oil pan 24 (see FIG. 2) to form a lower bent portion 60. The right upstream branch pipes 331 and 332 extend upward from the lower bent portion 60 to be tilted outward (rightward) in the width direction, and then are gathered at a location in front of a lower region of the crankcase 20 (see FIG. 2) to form one pipe, which extends to form a downstream end portion 33B. Likewise, the left upstream branch pipes 341 and 342 of the left upstream pipe 34 are bent rearward and upward at a location in front of the oil pan 24 to form a lower bent portion 61. The left upstream branch pipes 341 and 342 extend upward from the lower bent portion 61 to be tilted outward (leftward) in the width direction, and then are gathered at a location in front of the lower region of the crankcase 20 to form one pipe, which extends to form a downstream end portion 34B.

As shown in FIG. 3, an upstream end portion 41A of a right intermediate branch pipe 41 of an intermediate pipe 40 forming an intermediate portion of the exhaust pipe 31 is coupled to the downstream end portion 33B of the right upstream pipe 33 through an exhaust gas purifier 65. An upstream end portion 42A of a left intermediate branch pipe 42 of the intermediate pipe 40 is coupled to the downstream end portion 34B of the left upstream pipe 34 through an exhaust gas purifier 66. The exhaust gas purifiers 65 and 66 contain catalysts (not shown) therein. The catalysts serve to purify the exhaust gas flowing from the right upstream pipe 33 toward the right intermediate branch pipe 41 and the gas flowing from the left upstream pipe 34 toward the left intermediate branch pipe 42.

As shown in FIGS. 3 and 4, the right intermediate branch pipe 41 extends from the upstream end portion 41A and then is curved inward (leftward) in the width direction and bent to extend downward to form an upper bent portion 62. The left intermediate branch pipe 42 extends upward from the upstream end portion 42A and then is curved inward (leftward) in the width direction and bent to extend downward to form an upper bent portion 63. In other words, the right intermediate branch pipe 41 and the left intermediate branch pipe 42 are curved closer to each other and bent to extend downward at the upper bent portions 62 and 63. Then, they are gathered at a location downstream of the upper bent portions 62 and 63 to form one pipe, which extends to form the downstream end portion 40B of the intermediate pipe 40.

An upstream end portion 50A of the downstream pipe 50 forming a downstream portion of the exhaust pipe 31 is coupled to the downstream end portion 40B of the intermediate pipe 40. The downstream pipe 50 extends downward between the right and left intermediate branch pipes 41 and 42 of the intermediate pipe 40. A muffler 51 is coupled to a downstream end portion 50B of the downstream pipe 50. The muffler 51 is of a substantially rectangular parallelepiped shape. The muffler 51 is disposed below the crankcase 20 of the engine E and on the right side of the oil pan 24 (see FIG. 4).

In accordance with the exhaust system 30 constructed as described above, the length of exhaust pipe 31 in a longitudinal direction of the vehicle body is made short, and the muffler 51 is disposed below the crankcase 20 of the engine E, it becomes possible to position the components in the exhaust system 30 in the vicinity of the center of gravity Em (see FIG. 2) of the engine E, and to thus position the center of gravity of the motorcycle 1 lower.

In this embodiment, since the catalysts contained in the exhaust gas purifiers 65 and 66 are typically able to produce a higher purifying effect for higher-temperature exhaust gases, the exhaust gas purifier 65 is disposed between the lower bent portion 60 and the upper bent portion 62 and the exhaust gas purifier 66 is disposed between the lower bent portion 61 and the upper bent portion 63. Alternatively, one of the exhaust gas purifiers may be disposed downstream of the region at which the right intermediate branch pipe 41 and the left intermediate branch pipe 42 are gathered, so long as a temperature condition of the exhaust gas existing there is in an allowable range. In this case, since only one exhaust gas purifier is equipped in the exhaust system 30, the number of parts and a manufacturing cost can be reduced.

Embodiment 2

Figure 5:
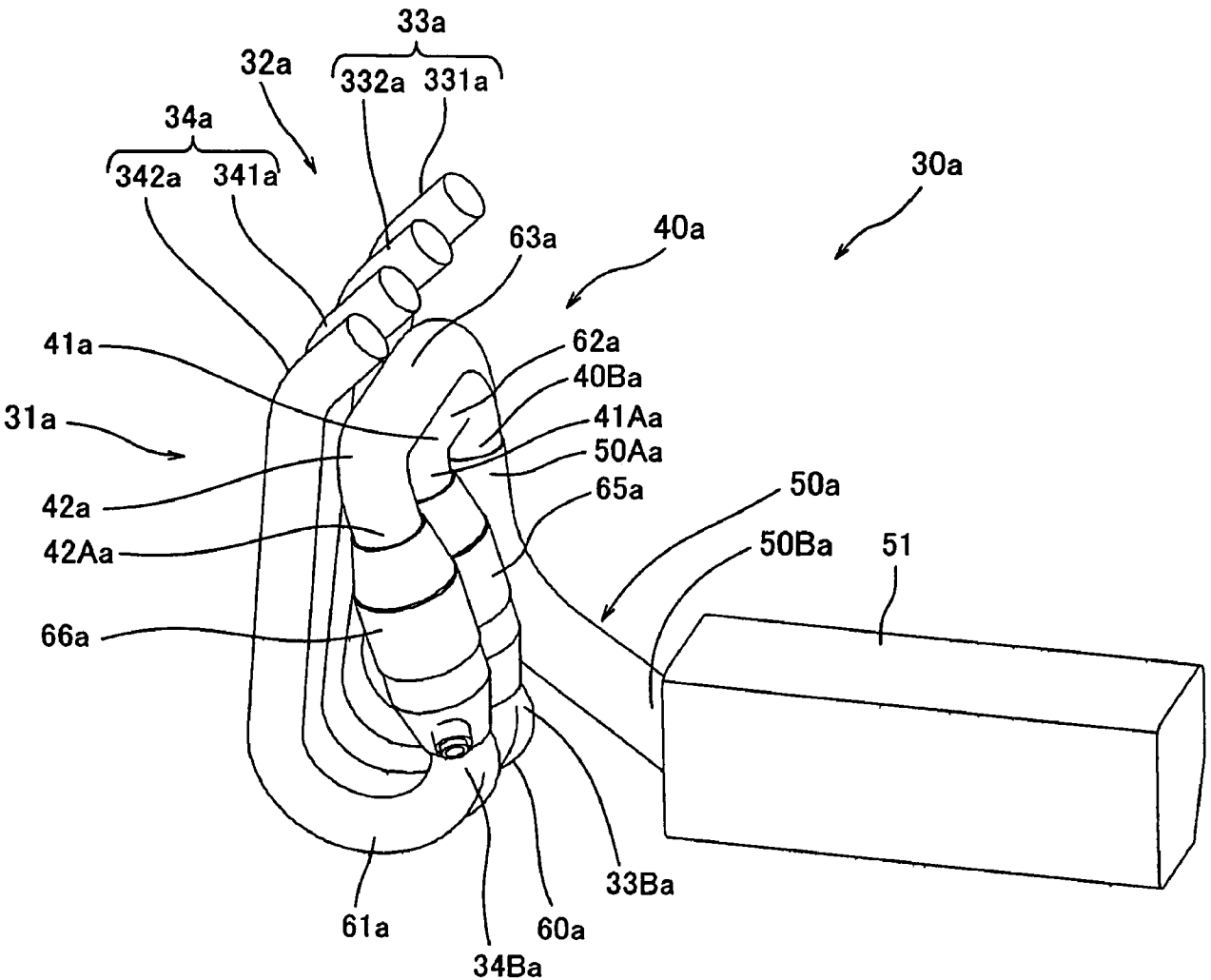
FIG. 5 is a perspective view of an exhaust system having another construction according to a second embodiment which is able to be coupled to the engine of the motorcycle of FIG. 1.
Figure 6:
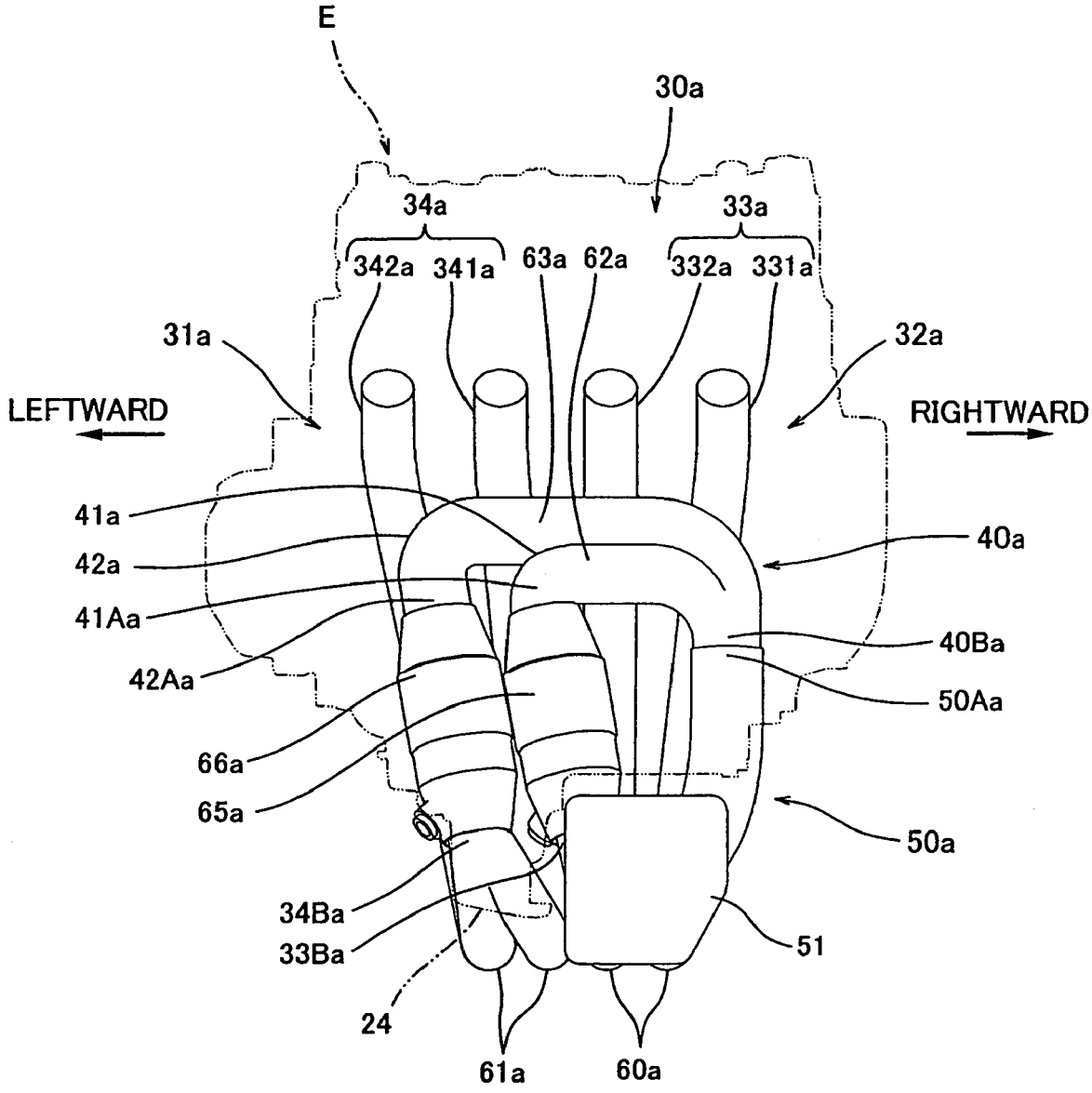
FIG. 6 is a rear view of the exhaust system of FIG. 5, showing an outer shape of the engine by a two-dotted line to illustrate how components in the exhaust system are arranged with respect to the engine.

FIG. 5 is a perspective view showing an exhaust system 30*a* having another construction which is able to be coupled to the engine E of the motorcycle 1 of FIG. 1. FIG. 6 is a rear view of the exhaust system 30*a* of FIG. 5, showing an outer shape of the engine E by a two-dotted line to illustrate how components in the exhaust system 30*a* are arranged with respect to the engine E. Hereinbelow, in FIGS. 5 and 6, components having the same functions as those of the components in the exhaust system 30 of the first embodiment are identified by reference symbols to which "a" is added, and will not be further described.

As shown in FIGS. 5 and 6, an exhaust pipe 31*a* in the exhaust system 30*a* includes an upstream pipe 32*a*, an intermediate pipe 40*a*, and a downstream pipe 50*a*. The upstream pipe 32*a* includes a right upstream pipe 33*a* into which right upstream branch pipes 331*a* and 332*a* respectively coupled to the right exhaust ports 25A and 25B (see FIG. 2) of the engine E are gathered, and a left upstream pipe 34*a* into which left upstream branch pipes 341*a* and 342*a* respectively coupled to the left exhaust ports 25C and 25D (see FIG. 2) of the engine E are gathered. The right upstream branch pipes 331*a* and 332*a* extend upward to be tilted leftward from a lower bent portion 60*a*, and then are gathered at a location in front of the lower region of the crankcase 20 (see FIG. 2) to form one pipe, which extends to form a downstream end portion 33Ba. The left upstream branch pipes 341*a* and 342*a* extend upward to be tilted leftward from a lower bent portion 61*a*, and then are gathered at a location in front of the lower region of the crankcase 20 to form one pipe, which extends to form a downstream end portion 34Ba.

An upstream end portion 41Aa of a right intermediate branch pipe 41*a* of an intermediate pipe 40*a* is coupled to the downstream end portion 33Ba of the right upstream pipe 33*a* through an exhaust gas purifier 65*a*. An upstream end portion 42Aa of a left intermediate branch pipe 42*a* of the intermediate pipe 40*a* is coupled to the downstream end portion 34Ba of the left upstream pipe 34*a* through an exhaust gas purifier 66*a*. The upstream end portion 41Aa of the right intermediate branch pipe 41*a* and the upstream end portion 42Aa of the left intermediate branch pipe 42*a* are located on the left side relative to the center in the width direction of the vehicle body. The right intermediate branch pipe 41*a* and the left intermediate branch pipe 42*a* extend upward from the upstream end portions 41Aa and 42Aa and then are curved rightward and bent to extend downward to form upper bent portions 62*a* and 63*a*, respectively. In other words, the right intermediate branch pipe 41*a* and the left intermediate branch pipe 42*a* extend to be curved clockwise at the upper bent portions 62*a* and 63*a*, respectively, as seen in a rear view. The upper bent portion 63*a* of the left intermediate branch pipe 42*a* extends above the upper bent portion 62*a* of the right intermediate branch pipe 41*a*. The right intermediate branch pipe 41*a* and the left intermediate branch pipe 42*a* are gathered at a location downstream of the upper bent portions 62*a* and 63*a* to form one pipe, which extends to form a downstream end portion 40Ba of the intermediate pipe 40*a*.

An upstream end portion 50Aa of the downstream pipe 50*a* is coupled to the downstream end portion 40Ba of the intermediate pipe 40*a*. The downstream pipe 50*a* extends downward through the right side of the exhaust gas purifiers 65*a* and 66*a*. The muffler 51 is coupled to a downstream end portion 50Ba of the downstream pipe 50*a*.

In accordance with the exhaust system 30*a* constructed as described above, it is possible to easily locate the downstream end portion (downstream end portion 50Ba of the downstream pipe 50*a*) of the exhaust pipe 31*a* on the right side relative to the center in the width direction of the vehicle body. Therefore, when the oil pan 24 is disposed on the left side under the crankcase 20 as in the engine E, the exhaust pipe 31*a* is easily extended and coupled to the muffler 51 disposed on the right side of the oil pan 24 (see FIG. 6). In this embodiment, also, the exhaust gas purifiers 65*a* and 66*a* may be replaced by one exhaust gas purifier located downstream of the region at which the right intermediate branch pipe 41*a* and the left intermediate branch pipe 42*a* are gathered.

While in the second embodiment, the exhaust pipe 31*a* is constructed in such a manner that the right intermediate branch pipe 41*a* and the left intermediate branch pipe 42*a* are curved clockwise at the upper bent portions 62*a* and 63*a*, respectively, they may alternatively be configured to extend counterclockwise. In this case, the upstream pipe 32*a*, the intermediate pipe 40*a*, and the downstream pipe 50*a*, which form the exhaust pipe 31*a*, may be symmetric in the width direction to those of FIGS. 5 and 6. In such a construction, it is possible to easily locate the downstream end portion of the exhaust pipe 31*a* on the left side relative to the center in the width direction of the vehicle body. Therefore, in the construction in which the oil pan 24 is disposed under and rightward of the crankcase 20, the exhaust pipe 31*a* can be easily coupled to the muffler 51 disposed on the left side of the oil pan 24.

Embodiment 3

Figure 7:
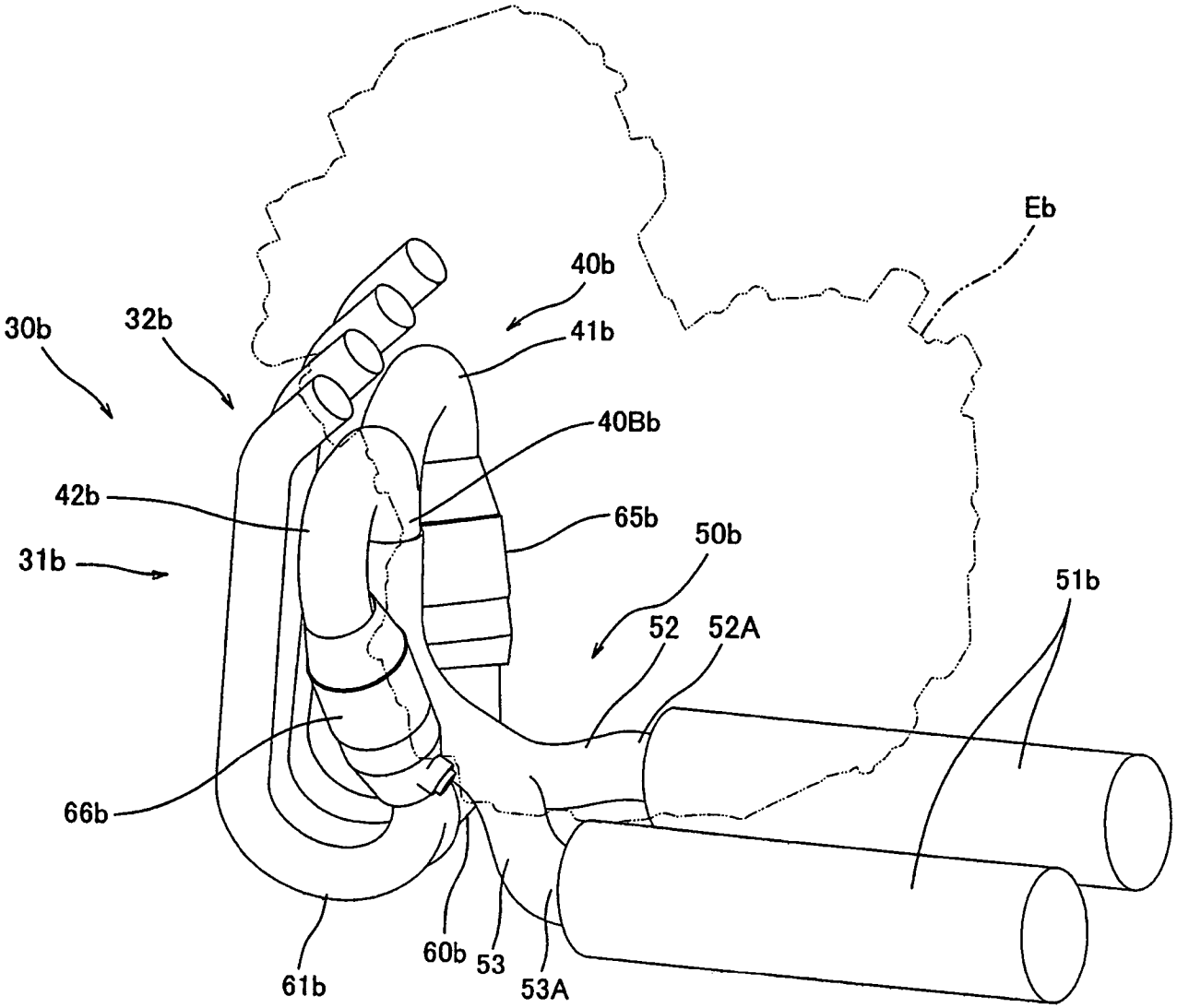
FIG. 7 is a perspective view of an exhaust system according to a third embodiment of the present invention, showing an outer shape of the engine by a two-dotted line to illustrate how components in the exhaust system are arranged with respect to the engine.

FIG. 7 is a perspective view of an exhaust system 30*b* having another construction, showing an outer shape of an engine Eb by a two-dotted line to illustrate how components in the exhaust system 30*b* are arranged with respect to the engine Eb. The engine Eb is an in-line four-cylinder engine that is able to be incorporated into the above mentioned motorcycle 1. Hereinbelow, in FIG. 7, components having the same functions as those of the components in the exhaust system 30 of the first embodiment are identified by reference symbols to which "b" is added, and will not be further described.

As shown in FIG. 7, an exhaust pipe 31*b* in the exhaust system 30*b* includes an upstream pipe 32*b*, an intermediate pipe 40*b*, and a downstream pipe 50*b*. The upstream pipe 32*b* and the intermediate pipe 40*b* have structures similar to those of the upstream pipe 32 and the intermediate pipe 40 described in the first embodiment. The upstream pipe 32*b* and the intermediate pipe 40*b* are coupled to each other through exhaust gas purifiers 65*b* and 66*b*.

The downstream pipe 50*b* extends downward from a downstream end portion 40Bb of the intermediate pipe 40*b* and between the right exhaust gas purifier 65*b* and the left exhaust gas purifier 66*b*. The downstream pipe 50*b* is curved to extend rearward near a location at which a part of the downstream pipe 50*b* is between lower bent portions 60*b* and 61*b* of the upstream pipe 32*b*, and further branches into a right downstream branch pipe 52 and a left downstream branch pipe 53 which extend rightward and leftward to form downstream end portions 52A and 53A, respectively. Mufflers 51*b* are arranged on the right and left sides and are coupled to the downstream end portions 52A and 53A, respectively. The engine Eb typically has a substantially flat bottom surface, which may be entirely flat. The mufflers 51*b* are disposed under the bottom surface of the engine Eb.

The exhaust system 30*b* is able to produce a higher muffling effect, because of the two mufflers 51*b*. In addition, since the mufflers 51*b* are arranged on the right and left sides under the engine Eb, the exhaust system 30*b* can be suitably coupled to the engine Eb having the flat bottom surface.

Embodiment 4

Figure 8:
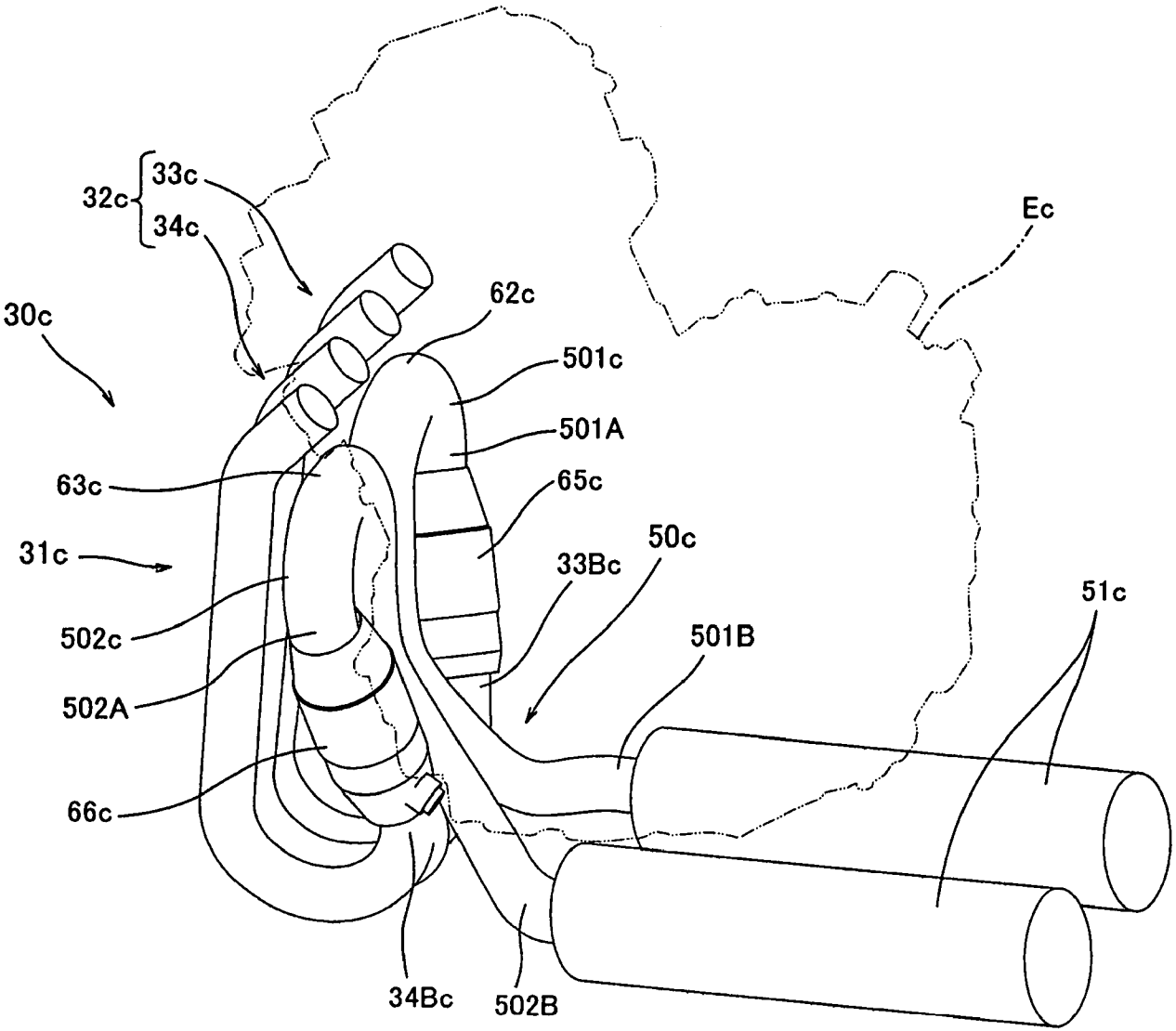
FIG. 8 is a perspective view of an exhaust system according to a fourth embodiment of the present invention, showing an outer shape of the engine by a two-dotted line to illustrate how components in the exhaust system are arranged with respect to the engine.

FIG. 8 is a perspective view of an exhaust system 30*c* having another construction, showing an outer shape of an engine Ec by a two-dotted line to illustrate how components in the exhaust system 30*c* are arranged with respect to the engine Ec. The engine Ec is an in-line four-cylinder engine that is able to be incorporated into the above mentioned motorcycle 1. Hereinbelow, in FIG. 8, components having the same functions as those of the components in the exhaust system 30 of the first embodiment are identified by reference symbols to which "c" is added, and will not be further described.

As shown in FIG. 8, an exhaust pipe 31*c* in the exhaust system 30*c* includes an upstream pipe 32*c* and a downstream pipe 50*c*. The upstream pipe 32*c* has a structure similar to that of the upstream pipe 32 described in the first embodiment, and includes a right upstream pipe 33*c* and a left upstream pipe 34*c*. The downstream pipe 50*c* includes a right downstream pipe 501*c* and a left downstream pipe 502*c*, which respectively have an upstream end portion 501A and an upstream end portion 502A, which are respectively coupled to the right upstream pipe 33*c* and the left upstream pipe 34*c*. The right downstream pipe 501*c* and the left upstream pipe 502*c* also respectively have a downstream end portion 501B and a downstream end portion 502B, which are respectively coupled to mufflers 51*c* arranged on the right and left sides under the engine E. The engine Ec typically has a substantially flat bottom surface, which may be entirely flat.

To be specific, the upstream end portion 501A of the right downstream pipe 501*c* of the downstream pipe 50*c* is coupled to a downstream end portion 33Bc of the right upstream pipe 33*c* through an exhaust gas purifier 65*c*. The right upstream pipe 501*c* is curved inward (leftward) in the width direction of the vehicle body and is bent to extend downward to form an upper bent portion 62*c*. Further, the right downstream pipe 501*c* extends downward from the upper bent portion 62*c* and then is curved to extend rearward, and the downstream end portion 501B thereof is coupled to the muffler 51*c* disposed on the right side under the engine Ec.

Likewise, the upstream end portion 502A of the left downstream pipe 502*c* of the downstream pipe 50*c* is coupled to the downstream end portion 34Bc of the left upstream pipe 34*c* through an exhaust gas purifier 66*c*. The left downstream pipe 502*c* is curved inward (rightward) in the width direction of the vehicle body and is bent to extend downward to form an upper bent portion 63*c*. Furthermore, the left downstream pipe 502*c* extends downward from the upper bent portion 63*c* and then are curved to extend rearward, and the downstream end portion 502B thereof is coupled to a muffler 51*c* disposed on the left side under the engine Ec.

The exhaust system 30*c* constructed above is able to produce a higher muffling effect, because of the two mufflers 51*c*. In addition, since the mufflers 51*c* are arranged on the right and left sides under the engine Ec, the exhaust system 30*c* can be suitably applied to the engine Ec having the flat bottom surface.

While the above mentioned exhaust systems are applied to the in-line four-cylinder engine E mounted in the motorcycle 1 of the road sport type, they may alternatively be coupled to other engines of other motorcycles, such as engines mounted in cruising or touring type motorcycles, multi-cylinder engines other than the four-cylinder engine, or V-type engines. Moreover, the exhaust system may be applied to engines mounted in all terrain vehicles having right and left front and rear wheels.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An exhaust system of an engine of a motorcycle, comprising:

an exhaust pipe configured to extend in one of an upward direction and a downward direction from an exhaust port formed at a front portion of a cylinder head of the engine and to then be bent to extend in an opposite direction to form a bent portion at a location in front of the engine, wherein the bent portion includes a lower bent portion and an upper bent portion located above the lower bent portion, the exhaust pipe extending in the downward direction and then being bent to extend in the upward direction to form the lower bent portion, the exhaust pipe extending in the upward direction and then being bent to extend in the downward direction to form the upper bent portion;

wherein the exhaust pipe is configured to extend downward from the exhaust port, upward from the lower bent portion, downward from the upper bent portion and then rearward;

the exhaust pipe extending in the upward direction and then in a lateral direction and then being bent to extend in the downward direction to form the upper bent portion.

2. The exhaust system according to claim 1, further comprising:

a muffler that is located below a crankcase of the engine and is coupled to the exhaust pipe.

3. The exhaust system according to claim 1, further comprising:

an exhaust gas purifier that is disposed at a location of the exhaust pipe between the lower bent portion and the upper bent portion and upstream of the upper bent portion in a flow direction of an exhaust gas and is configured to purify an exhaust gas emitted from the exhaust port of the engine.

4. The exhaust system according to claim 3, wherein the engine is an in-line multi-cylinder engine and the exhaust port is one of a plurality of exhaust ports arranged in a width direction of a vehicle body of the motorcycle;

wherein the plurality of exhaust ports are divided into a right exhaust port group and a left exhaust port group that are located on a right side and on a left side of the vehicle body, respectively, as viewed from above, and the exhaust pipe includes a right pipe group extending from the right exhaust port group and a left pipe group extending from the left exhaust port group;

and wherein pipes of at least one of the right pipe group and the left pipe group are gathered to form one pipe at a location between the lower bent portion and the upper bent portion, and the exhaust gas purifier is disposed at the one pipe to be located upstream of the upper bent portion in the flow direction of the exhaust gas.

5. An exhaust system of an engine of a motorcycle, the engine being an in-line four-cylinder engine, comprising:

an exhaust pine configured to extend in one of an upward direction and a downward direction from four exhaust ports arrange in a width direction of the engine at a front portion of the engine and to then be bent to extend in and opposite direction to form a bent portion at a location in front of the engine;

wherein the bent portion includes a lower bent portion and an upper bent portion located above the lower bent portion, the exhaust pipe extending in the downward direction and then being bent to extend in the upward direction to form the lower bent portion, the exhaust pip extending in the upward direction and then being bent to extend in the downward direction to form the upper bent portion;

wherein the exhaust pipe is configured to extend downward from the exhaust ports. upward from the lower bent portion, downward from the upper bent portion and then rearward;

wherein the exhaust pipe includes a right upstream pipe through which exhaust gases from two exhaust ports located on a right side of the vehicle body as viewed from above are guided and gathered, a left upstream pipe through which exhaust gases from two exhaust ports located on a left side of the vehicle body as viewed from above are guided and gathered, an intermediate pipe through which exhaust gases from the right upstream pipe and the left upstream pipe are guided and gathered, and a downstream pipe through which an exhaust gas from the intermediate pipe Is guided outside the engine;

wherein each of the right upstream pipe and the left upstream pipe has the lower bent portion and is coupled to the intermediate pipe at a location downstream of the lower bent portion;

and wherein the intermediate pipe has the upper bent portion and is coupled to the downstream pipe at a location downstream of the upper bent portion.

6. The exhaust system according to claim 5, wherein the intermediate pipe includes two branch pipes coupled to the right upstream pipe and the left upstream pipe, respectively;

and wherein the branch pipes extend upward, are curved inward in the width direction of the vehicle body and bent at the upper bent portion, and then are gathered;

and wherein the downstream pipe extends downward through a location between the two branch pipes of the intermediate pipe.

7. The exhaust system according to claim 5, wherein the intermediate pipe has two branch pipes coupled to the right upstream pipe and the left upstream pipe, wherein the branch pipes extend upward to be located on one of right and left sides relative to a center in the width direction of the vehicle body, are curved to be bent toward an opposite side at the upper bent portion, and then are gathered;

and wherein the downstream pipe extends downward through the opposite side of the branch pipes.

8. The exhaust system according to claim 5, further comprising:

an exhaust gas purifier configured to purify an exhaust gas emitted from the exhaust port of the engine;

wherein the left upstream pipe and the right upstream pipe are each coupled to the intermediate pipe through the exhaust gas purifier.

9. The exhaust system according to claim 5, wherein the downstream pipe is divided into right and left branch pipes having respective downstream end portions coupled to respective mufflers.

10. An exhaust system of an engine of a motorcycle, the engine being an In-line tour-cylinder engine, comprising:

an exhaust pipe configured to extend in one of an upward direction and a downward direction from four exhaust ports arranged in a width direction of the engine at a front portion of the engine and to then be bent to extend in an opposite direction to form a bent portion at a location in front of the engine, wherein the bent portion includes a lower bent portion and an upper bent portion located above the lower bent portion, the exhaust pipe extending in the downward direction and then being bent to extend in the upward direction to form the lower bent portion, the exhaust pipe extending in the upward direction and then being bent to extend in the downward direction to form the upper bent portion;

wherein the exhaust pipe is configured to extend downward from the exhaust ports, upward from the lower bent portion, downward from the upper bent portion and then rearward;

wherein the exhaust pipe includes a right upstream pipe through which exhaust gases from two exhaust ports located on a right side of the vehicle body as viewed from above are guided and gathered, a left upstream pipe through which exhaust gases from two exhaust ports located on a left side of the vehicle body are guided and gathered, a right downstream pipe through which the exhaust gas from the right upstream pipe flows, and a left downstream pipe through which the exhaust gas from the left upstream pipe flows;

wherein each of the right upstream pipe and the left upstream pipe has the lower bent portion, and the right upstream pipe and the left upstream pipe are coupled to the right downstream pipe and the left downstream pipe, respectively, at a location downstream of the lower bent portion;

and wherein each of the right downstream pipe and the left downstream pipe has the upper bent portion, and the right downstream pipe and the left downstream pipe are coupled to right and left mufflers, respectively, at a location downstream of the upper bent portion.

* * * * *